US009556574B2

(12) United States Patent
Abeles

(10) Patent No.: US 9,556,574 B2
(45) **Date of Patent: *Jan. 31, 2017**

(54) PORTABLE WATER-INFLATABLE BARRIER

(71) Applicant: Gary E Abeles, Verona, NJ (US)

(72) Inventor: Gary E Abeles, Verona, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/016,606

(22) Filed: Feb. 5, 2016

(65) Prior Publication Data

US 2016/0153160 A1 Jun. 2, 2016

Related U.S. Application Data

(63) Continuation of application No. 14/594,407, filed on Jan. 12, 2015, now Pat. No. 9,334,616, which is a continuation-in-part of application No. 13/663,756, filed on Oct. 30, 2012, now Pat. No. 8,956,077.

(60) Provisional application No. 61/553,403, filed on Oct. 31, 2011.

(51) Int. Cl.

| | |
|---|---|
| ***E02B 3/10*** | (2006.01) |
| ***E02B 3/12*** | (2006.01) |
| ***E02B 7/00*** | (2006.01) |

(52) U.S. Cl.

CPC ..... *E02B 3/108* (2013.01); *E02B 3/127* (2013.01); *E02B 7/005* (2013.01)

(58) Field of Classification Search

CPC ..... E02B 3/108; E02B 3/127; E02B 7/005

See application file for complete search history.

(56) References Cited

U.S. PATENT DOCUMENTS

| | | | | | |
|---|---|---|---|---|---|
| 3,213,628 | A * | 10/1965 | Serota | E02B 3/108 | 220/62.21 |
| 4,692,060 | A * | 9/1987 | Jackson, III | E02B 3/108 | 256/13 |
| 4,784,520 | A * | 11/1988 | Stevens | E01D 19/02 | 405/107 |
| 5,059,065 | A * | 10/1991 | Doolaege | E02B 7/005 | 405/107 |
| 5,125,767 | A * | 6/1992 | Dooleage | E02B 3/108 | 405/114 |
| 5,176,468 | A * | 1/1993 | Poole | E02B 3/06 | 405/111 |

(Continued)

FOREIGN PATENT DOCUMENTS

| | | | | |
|---|---|---|---|---|
| DE | 10119011 C1 * | 2/2003 | ..... | E02B 3/108 |
| FR | 2860251 A1 * | 4/2005 | ..... | E02B 3/108 |

*Primary Examiner* — Frederick L Lagman

(74) *Attorney, Agent, or Firm* — Maine Cernota & Rardin

(57) ABSTRACT

A portable, water-filled module suitable for use as a barrier or inclusion in a barrier is internally divided into cells and emulates a section of a sandbag dike or wall without requiring sand or intensive labor to install. Automatic valves can seal openings between the filled cells, so that a punctured cell will not cause cells below and behind to deflate. Cells can project below the base into a stabilizing trench. Some embodiments can be initially filled with air, positioned, and then filled with water while the air escapes through a pressure valve. Side structures of the module can enable interlocking with adjacent modules. In embodiments, rigid steps span the module to provide structural support and enable traversing of the module. The steps can be attachable to the module. The light, flexible walls of the module can include nanofiber.

22 Claims, 14 Drawing Sheets

(56) References Cited

U.S. PATENT DOCUMENTS

| | | | | |
|---|---|---|---|---|
| 5,857,806 | A * | 1/1999 | Melin | E02B 3/108 405/114 |
| 5,865,564 | A * | 2/1999 | Miller | E02B 3/108 405/114 |
| 6,022,172 | A * | 2/2000 | Siyaj | E02B 3/108 405/110 |
| 6,481,928 | B1 * | 11/2002 | Doolaege | E01D 15/20 138/98 |
| 6,551,025 | B2 * | 4/2003 | Dery | E02B 3/108 405/115 |
| 6,641,329 | B1 * | 11/2003 | Clement | E02B 3/108 405/115 |
| 8,956,077 | B2 * | 2/2015 | Abeles | E02B 3/108 405/111 |
| 9,334,616 | B2 * | 5/2016 | Abeles | E02B 3/127 |
| 2004/0047688 | A1 * | 3/2004 | Clement | E02B 3/108 405/115 |
| 2005/0260038 | A1 * | 11/2005 | Sousa Costa | E02B 3/127 405/115 |
| 2006/0099033 | A1 * | 5/2006 | Boraggina | E02B 3/108 405/107 |
| 2007/0140598 | A1 * | 6/2007 | McGillick, Sr. | B65D 88/1612 383/22 |
| 2007/0237586 | A1 * | 10/2007 | Prestininzi | E02B 3/108 405/115 |
| 2007/0283866 | A1 * | 12/2007 | Veazey | A01K 61/005 114/77 R |
| 2009/0274519 | A1 * | 11/2009 | Shaw | E02B 3/108 405/107 |
| 2010/0284747 | A1 * | 11/2010 | Peterson | E02B 3/108 405/114 |
| 2014/0010601 | A1 * | 1/2014 | Bradley, Sr. | E02B 3/06 405/302.7 |

* cited by examiner

PORTABLE WATER-INFLATABLE BARRIER

RELATED APPLICATIONS

This application is a continuation of application Ser. No. 14/594,407 filed on Jan. 12, 2015, now U.S. Pat. No. 9,334,616. Application Ser. No. 14/594,407 is a continuation in part of application Ser. No. 13/663,756, filed on Oct. 30, 2012, now U.S. Pat. No. 8,956,077. Application Ser. No. 13/663,756 claims the benefit of U.S. Provisional Application No. 61/553,403, filed Oct. 31, 2011. All of these applications are herein incorporated by reference in their entirety for all purposes.

FIELD OF THE INVENTION

The invention relates to temporary barriers, such as dikes used for flood control, and more particularly, to water-filled portable barriers.

BACKGROUND OF THE INVENTION

Circumstances sometimes arise where a temporary dike, wall, or other barrier is needed to prevent a flood, landslide, or other threat from spreading and threatening lives and property. Often, such a temporary barrier is constructed from sandbags, whereby empty bags and a quantity of dirt or sand is brought to the site, and a crew of workers fills the bags with the dirt or sand and stacks the bags to form the barrier. With reference to FIG. 1, the bags are often stacked so as to form a barrier with a "pyramid" cross-section 100 that is widest at the base, and narrower at the top.

In some cases, the barrier 100 is constructed on flat ground, and the weight of the sand in the barrier 100 is sufficient to hold the barrier 100 in place during the flood or other threat. With reference to FIG. 2, in other cases a shallow trench 200 is prepared first, the trench having a depth that is approximately equal to the thickness of one sandbag. One or two rows of sandbags 202 are laid in the trench 200, with the remainder of the barrier 100 being constructed on top of the initial one or two rows 202. In this way, friction between the sandbags in the trench and the remainder of the sandbags further helps to hold the barrier in place.

While a sandbag barrier is generally effective and the materials are relatively inexpensive, there can be significant costs and construction time associated with a sandbag dike, due to the requirement to bring the sand or dirt to the construction site, which may weigh many tons, and due to the need to employ significant labor to fill and stack the bags.

In addition, after the flood or other threat has subsided, disposal of the sandbags can be time consuming and costly, especially if the sand and bags have become wet and contaminated by flood water and require special disposal procedures to avoid risks to health and to the environment.

What is needed, therefore, is a portable dike, wall, or other barrier that functions in a manner similar to a sandbag dike or wall, but does not require delivery of large quantities of heavy materials to the construction site, does not require large amounts of labor to assemble, and is simple and inexpensive to remove when it is no longer needed.

SUMMARY OF THE INVENTION

A portable, water-inflatable barrier has an internal structure similar to a sandbag dike or wall, and functions in a similar manner, but does not require delivery of large quantities of heavy materials to the construction site, does not require large amounts of labor to assemble, and is simple and inexpensive to remove when no longer needed. The barrier is made of a light, flexible material such as a heavy plastic or nanofiber, and can be transported to the construction site in a deflated state, after which it is positioned and filled with locally available water.

In one general aspect of the present invention, the barrier is a single unit that includes shaping and internal partitions which create an overall structure similar to a sandbag wall. The interior of the barrier is divided into a plurality of approximately rectangular cells. Passages between the tops and bottoms of the cells allow the entire barrier to be filled from a single water inlet. In some embodiments, the cells include passive automatic valves that seal the passages after the cells are filled with water, so that deflation of one cell due to a puncture or some other cause will not cause the cells beneath it to deflate. In some embodiments, the outer shell of the barrier is made of a thicker material, such as thick plastic, a synthetic rubber, or a thick layer of nanofiber, so as to better resist puncture by an external threat. In similar embodiments, the outer shell is double-walled, so that puncture of the outer wall does not affect the internal cells, so long as the inner wall remains intact. In certain embodiments the walls are coated with a protective material such as tyvec or liquid rubber that will seal punctures if they occur.

The unitary nature of the barrier in these embodiments eliminates any concern about interlocking and potential separation of individual units. The internal structure of the barrier enables it to maintain its shape when the barrier is subjected to externally applied horizontal forces, such as pressure from flood waters. In some embodiments, the shape of the structure is made even more rigid by the inclusion within the cells of stiff, lightweight rods or plates made of plastic, bamboo, or a similar material.

In further embodiments, additional rows of cells extend below the base of the inflatable barrier so that they can be placed in a trench prepared at the construction site; thereby further resisting dislodgement of the barrier by flood waters or other forces.

In some embodiments, the barrier can be initially inflated with air, so that the barrier can be easily positioned while it is in its filled configuration. The barrier can then be filled with water, while the displaced air is released through a pressure valve at the top of the barrier.

In circumstances where a long dyke or other barrier is required, a plurality of barriers of the present invention can be placed side-by-side. In some embodiments, the barriers have interlocking ends that provide structural cooperation and a water-tight seal between adjacent barriers. In some of these embodiments, pre-inflation of the barriers with air allows them to be easily placed in their interlocking configuration before the air within the barriers is replaced by water.

In a second general aspect of the present invention, the barrier is assembled from individual, water-inflatable modules that interconnect with each other, by ties, hook-and-loop, or by any other attachment mechanism known in the art. In some of these embodiments, the individual modules are triangular or wedge-shaped in cross section, thereby allowing the modules to be assembled so as to create an overall shape that is optimal for a specific circumstance.

Embodiments of the present invention include an anchoring sheet that surrounds part or all of the barrier, or is otherwise attached to the barrier, and extends flat against the ground in front of the barrier, so that the weight of the water in front of the barrier presses the anchoring sheet against the ground and creates a high frictional resistance to movement, thereby anchoring the barrier in place. In some embodiments, the anchoring sheet covers a water-facing surface of the barrier, and is sufficiently flexible to allow it to conform closely with the underlying shape of the water-facing surface. And in some of these embodiments, the anchoring sheet is made from a material that naturally clings to the water-facing surface of the barrier due to static electrical attraction.

Other embodiments include a flexible underlying sheet that further resists puncture from beneath, and which seals to the ground so as to resist penetration of water beneath the barrier. In some of these embodiments, the underlying sheet includes a cushioning layer. In other of these embodiments, the underlying sheet is filled with dry sand, foam or some other compliant material that will not get wet from the flood water.

In some embodiments, a base width of the barrier is at least six times as large as a height of the barrier.

Some embodiments include steps that are configured to be free-standing, but to conform somewhat closely to the outer profile of the barrier. The steps allow for a convenient means for crossing the barrier, and provides additional structural support to the barrier by inhibiting distortion of the shape of the barrier. In embodiments, the steps further provide horizontal and/or vertical support to the barrier by including coupling features on the steps that can be attached to complementary coupling features provided on the top of the barrier.

The present invention is a water inflatable module suitable for use as a barrier or incorporation into a barrier. The module includes flexible walls configured to contain water within an interior of the module, said module having a front, a rear, a length parallel to the front, a width perpendicular to the front, and a substantially uniform cross-section along its length, the cross section being wider at a base of the module than at a top of the module. The module further includes a plurality of substantially horizontal and substantially vertical partition walls dividing said interior into a plurality of adjacent, water-tight cells shaped as rectangular parallelepipeds, front and rear partition walls of each cell being substantially parallel to the front of the shell, said cells being arranged in a plurality of vertically stacked layers that are offset from each other such that none of the front and rear partition walls aligns with a front or rear partition wall in a vertically adjacent layer. In addition, the module includes a water inlet, and a plurality of passages between the cells configured to allow filling of all of the cells with water from the water inlet.

Embodiments further include a structure reinforcing element that is external to the flexible walls.

Certain embodiments further include rigid steps spanning the width of the flexible walls in substantial conformance with a step-wise cross-sectional shape of the flexible walls, the steps being configured to enable an individual to traverse the flexible walls. Some of these embodiments further include a first coupling mechanism attached to the steps and a second coupling mechanism attached to the flexible walls, the coupling mechanisms being configured for attachment of the steps to the flexible walls. And some in some of these embodiments the coupling mechanisms are configured to enable the steps to provide vertical support to the flexible walls.

Some embodiments further include an automatic valve cooperative with a vertical passage between adjacent cells and configured to automatically seal the vertical passage when the cell below the vertical passage is filled with water.

Some embodiments further include an automatic valve cooperative with a horizontal passage between adjacent cells and configured to automatically seal the horizontal passage when the cell located to the rear of the horizontal opening is filled with water.

Embodiments include an interlocking side structure configured to interlock with a second module having a compatible side structure. In some embodiments the module is inflatable with air.

In some embodiments the base of the module is flat. In other embodiments, the base of the module includes at least one row of cells extending below other rows in the base, the extended rows being configured for placement in a trench prepared at a site where the module is to be installed.

In embodiments, the flexible walls are reinforced at least at the front of the module as compared to the partition walls. In some of these embodiments the flexible walls at the front of the module are reinforced due to an increased thickness of material relative to the partition walls. In other of these embodiments the flexible walls at the front of the module are reinforced due to inclusion of a material not included in the partition walls. In still other of these embodiments the flexible walls at the front of the module are reinforced due to inclusion of nanofiber in the flexible walls. In yet other of these embodiments the flexible walls at the front of the module are reinforced due to double-walled construction.

In some embodiments, the flexible walls include a coating of a protective material that tends to seal punctures. In some of these embodiments the protective material is tyvec or liquid rubber.

Certain embodiments further include an underlying sheet that resists puncture of the flexible walls from beneath, and which seals to the module and to the ground beneath the module so as to inhibit penetration of water beneath the module. In some of these embodiments, the underlying sheet is a cushioning layer. And in other of these embodiments the underlying sheet is filled with dry sand or foam.

And some embodiments further include a plurality of said modules aligned with adjacent sides so as to collectively form a water barrier, damn, or dyke.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
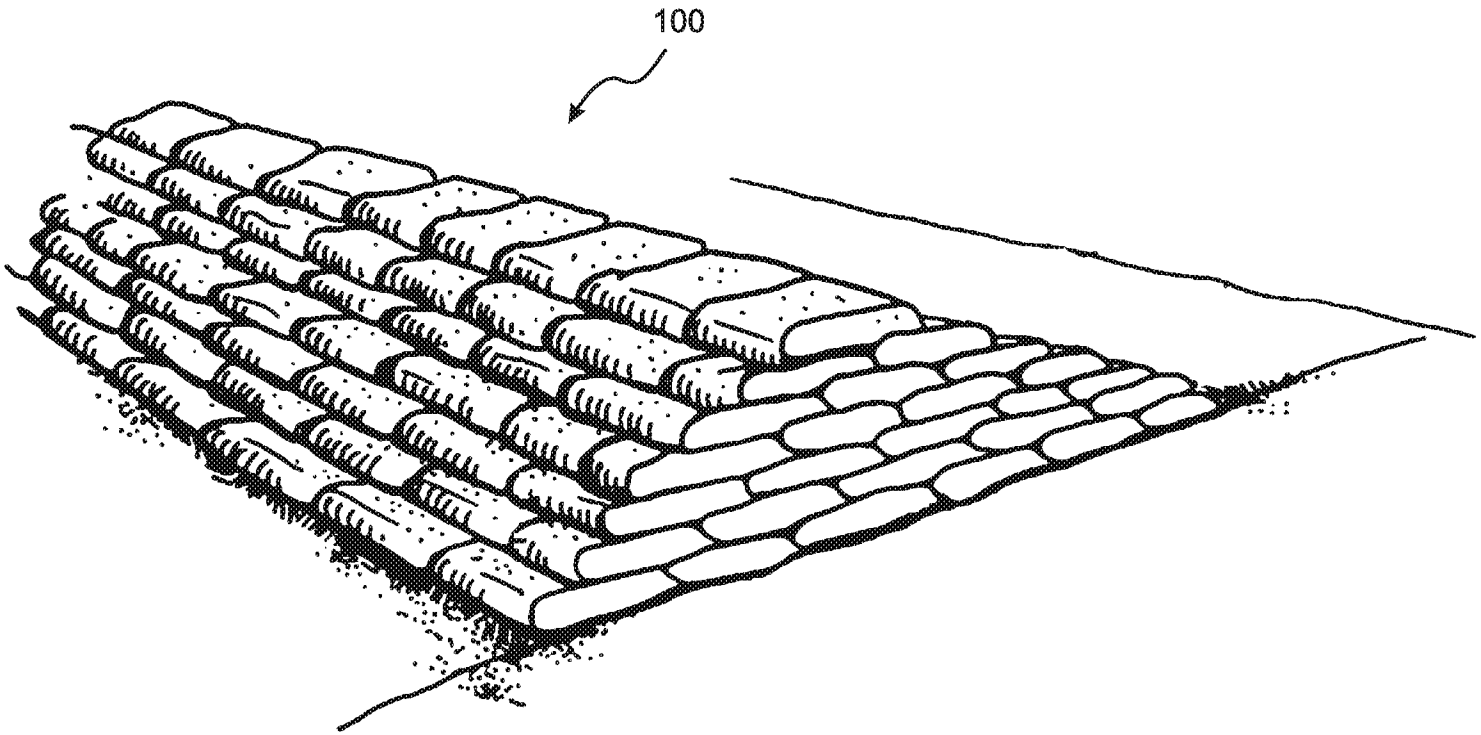
Figure 1 Prior Art
FIG. 1 is perspective view of a sandbag barrier of the prior art having a flat base.
Figure 2:
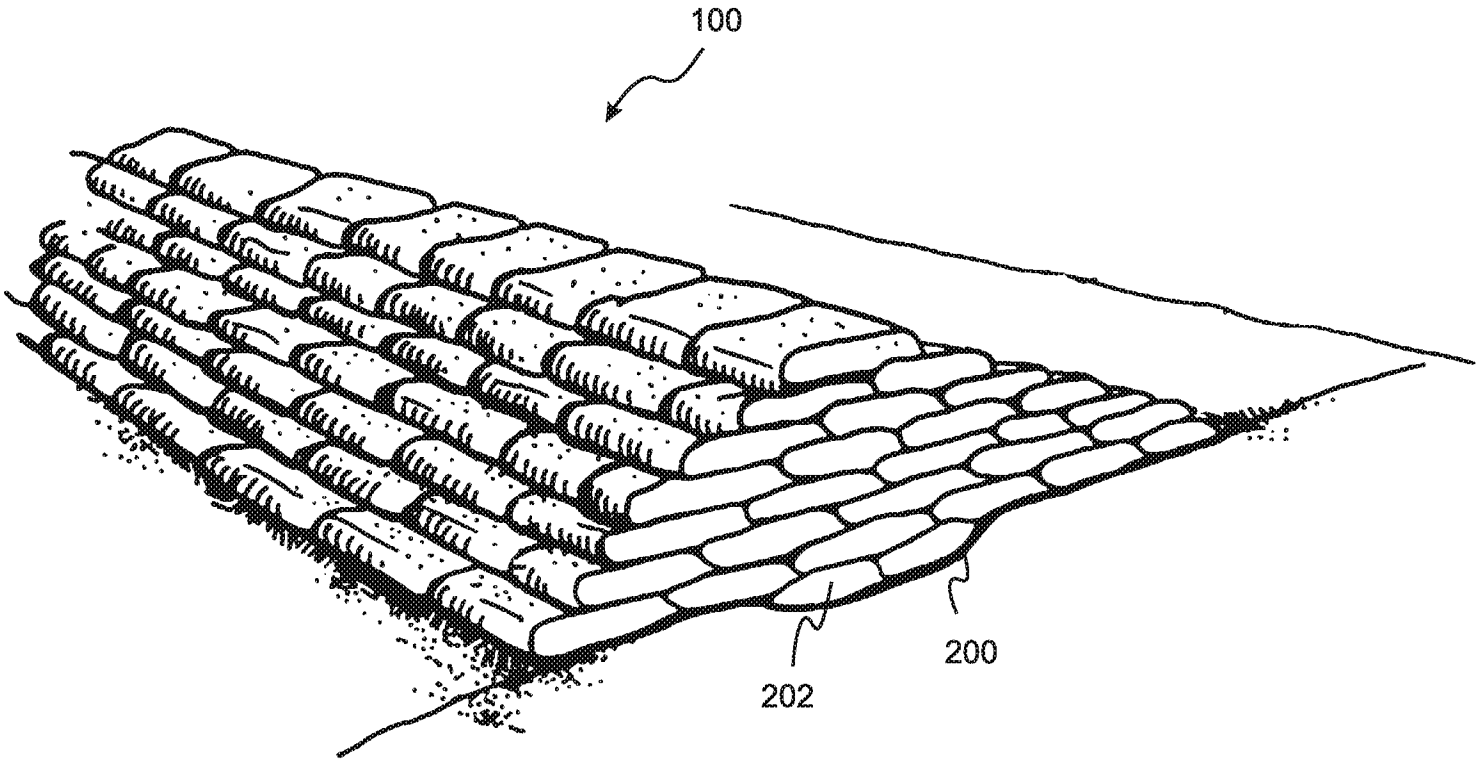
Figure 2 Prior Art
FIG. 2 is perspective view of a sandbag barrier of the prior art having two rows of sandbags at its base that are placed in a trench prepared at the construction site.
Figure 3:
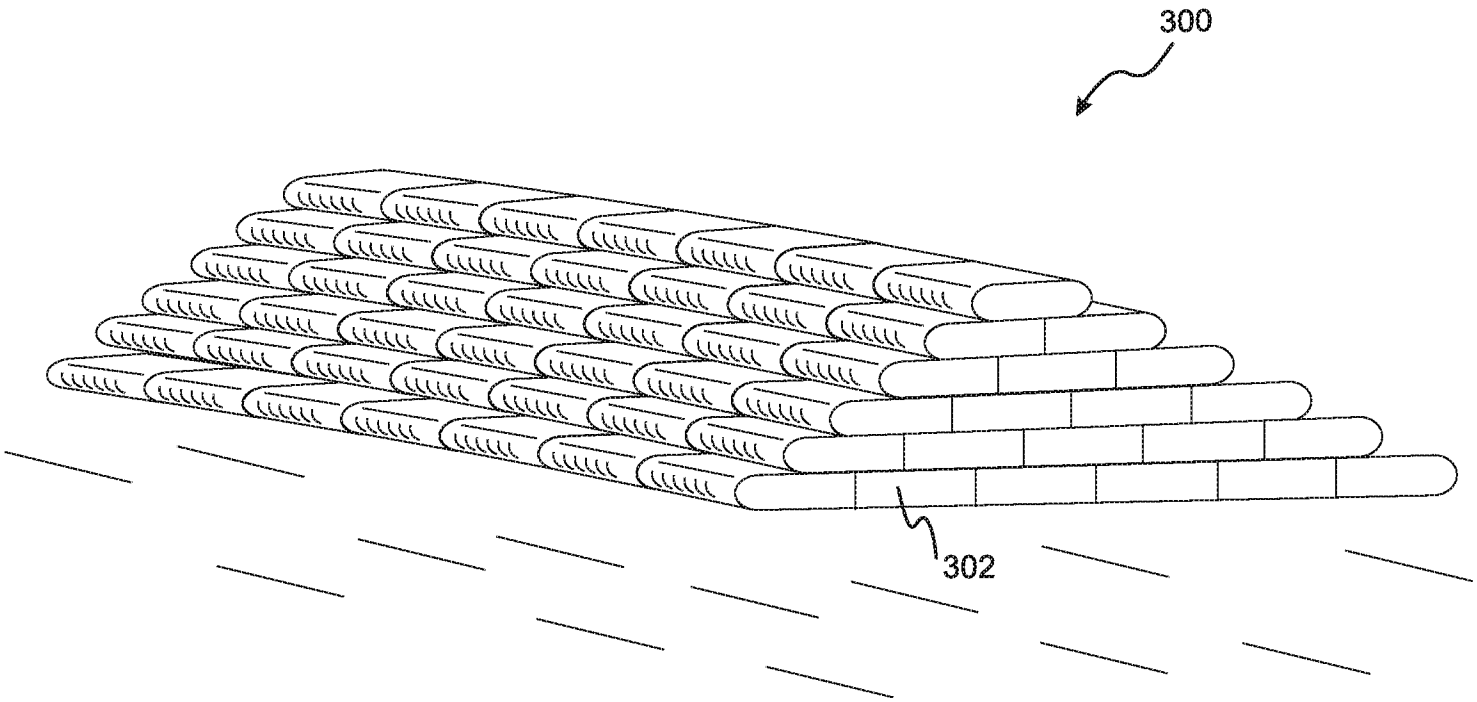
FIG. 3 is a perspective view of an embodiment of the present invention.

With reference to FIG. 3, the present invention is a portable, water-inflatable barrier 300 that has a structure similar to a sandbag dike or wall 100 and functions in a similar manner, but does not require delivery of large quantities of heavy materials to the construction site, does not require large amounts of labor to assemble, and is simple and inexpensive to remove when no longer needed. The barrier 300 is made of a light, flexible material, such as a heavy plastic for nanofiber, and can be transported to the construction site in a deflated state, after which it is positioned and filled with locally available water. In embodiments, the barrier material is coated with a material such as tyvec or liquid rubber that will tend to seal any puncture of the material that may occur.

Figure 4A:
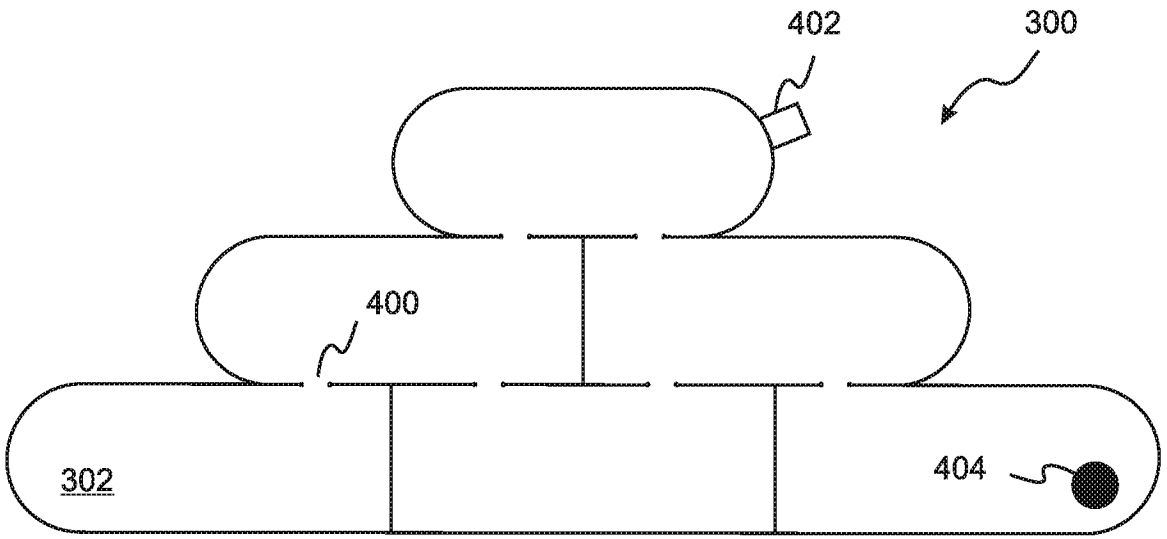
FIG. 4A is a cross sectional view of an embodiment having a water inlet on top, a water outlet near the bottom, and simple passages between tops and bottoms of cells.

FIG. 3 illustrates an embodiment of a first general aspect of the present invention in which the barrier is a single unit 300 that includes shaping and internal partitions which create an overall structure similar to a sandbag wall. The interior of the barrier is divided into a plurality of approximately rectangular cells 302. With reference to FIG. 4A, passages 400 between the tops and bottoms of the cells 302 allow the entire barrier 300 to be filled from a single water inlet 402. A separate water outlet 404 is provided at the base of the structure 300.

Figure 4B:
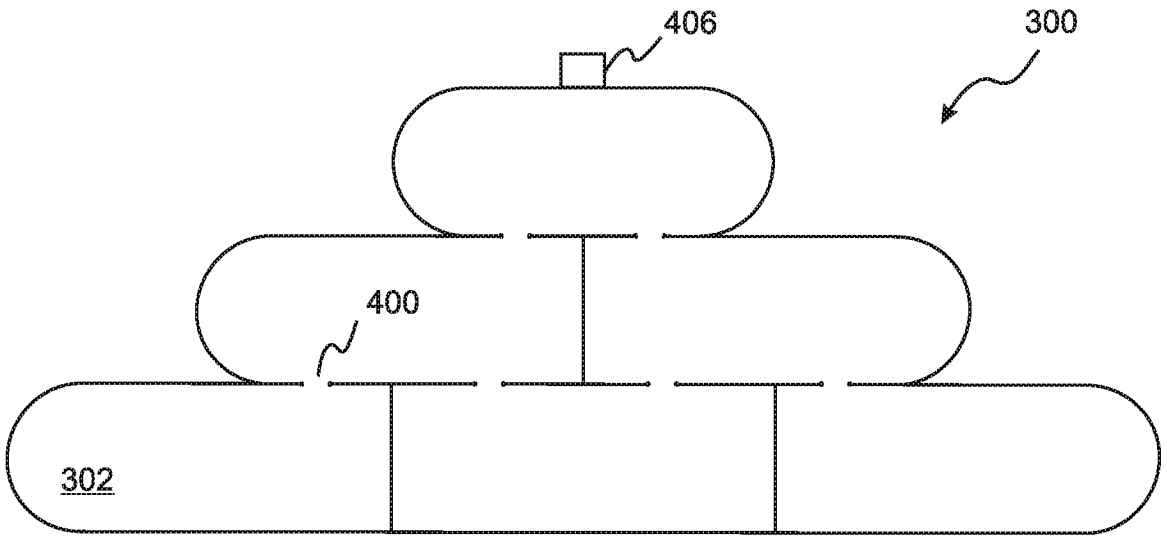
FIG. 4B is a cross sectional view of an embodiment similar to FIG. 4A, but including only a water port at the top through which the barrier is both filled and emptied with water.

With reference to FIG. 4B, in some embodiments a separate water outlet 404 is not included, and instead water is both added and removed through a common port 406 at or near the top of the barrier. This allows water to be removed from the barrier without introducing air, so that removing the water causes the barrier to be collapsed in preparation for packing and transport.

In some embodiments, lateral passages (not shown) are provided at least between adjoining cells in the bottom rear row, so that a single outlet can drain all of the cells 302 in the barrier 300.

Figure 5:
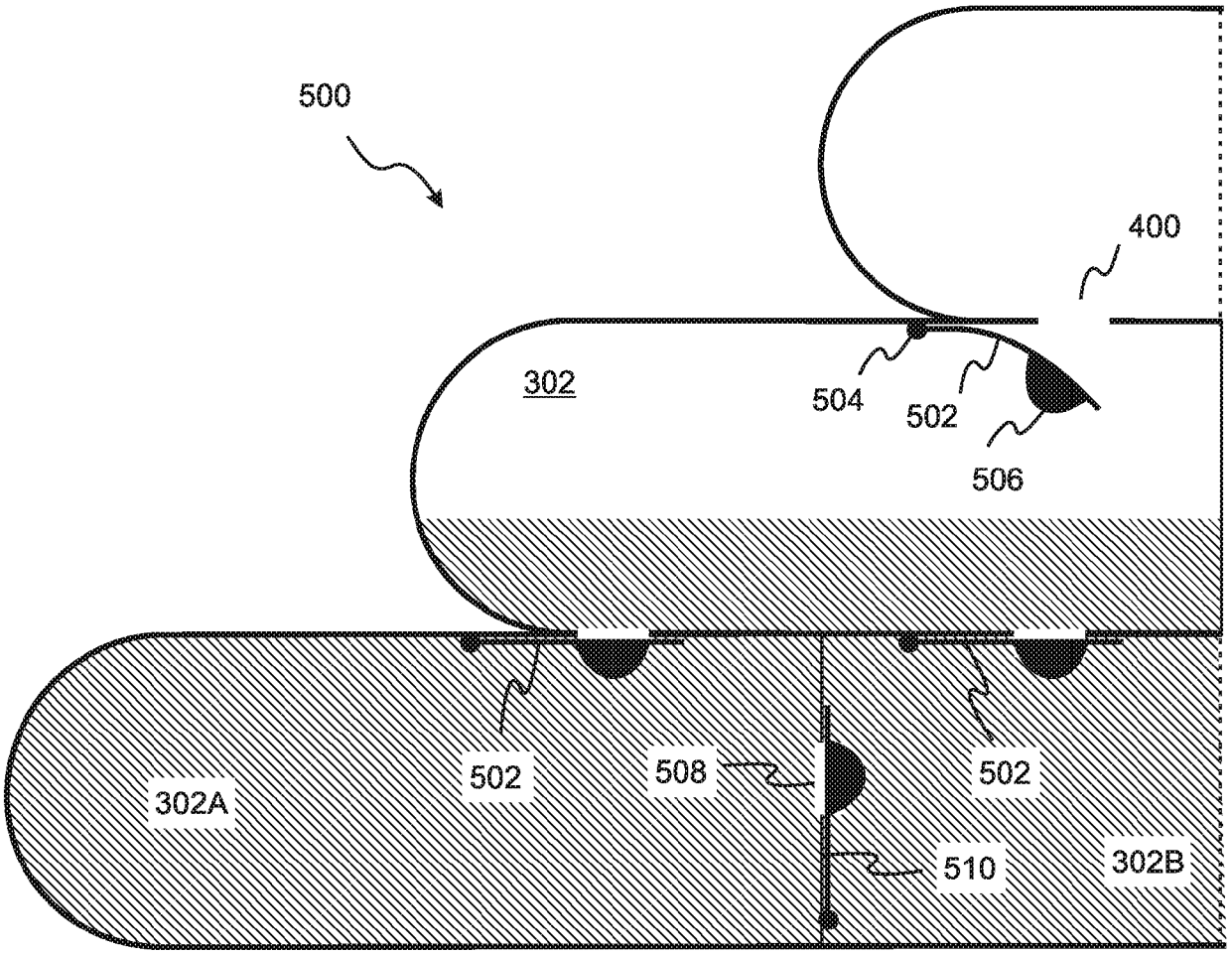
FIG. 5 is a partial cross sectional view of an embodiment having passages between tops and bottoms of cells that are closable by passive valves.

With reference to FIG. 5, in some embodiments 500 the cells 302 include passive automatic valves 500 that seal the passages 400 after the cells 302 are filled with water, so that deflation of one cell due to a puncture or some other cause will not cause the cells beneath it to deflate. In the embodiment 500 of FIG. 5, the valves 502 are flaps of elastic material joined to the upper surfaces of the cells 302 by living hinges 504. A small air bladder 506 is included in the region of the valve 502 that is positioned to cover the passage 400. When the cell 302 is empty, gravity causes the valve 502 to fall away from the passage 400, so that the cell 302 can fill with water. However, once the cell 302 is full of water, the air bladder 506 lifts the valve 502 into place and closes the passage 400. Once the valves 502 are closed, if a cell should develop a leak and deflate, only the cells directly above it will be affected.

In addition, the embodiment 500 of FIG. 5 includes lateral passages 508 between neighboring cells at the lowest level of the barrier, so that the entire barrier can be emptied through a single water outlet 404 located at the lower rear of the structure 500. These lateral passages 508 include automatic valves 510 that will allow water to flow toward the rear as the cells empty from back to front, but will prevent water flowing from rear to front if one of the front cells is damaged.

Typically, the cells in the front row 302, 302A will be the cells that are directly exposed to threats such as debris carried by flood waters. The front cells 302, 302A are therefore the ones most likely to be damaged or punctured. In the embodiment of FIG. 5, if a cell 302A in the bottom front row is punctured, the lateral valve 510 will prevent water from flowing out of the cell next to it 302B and into the damaged cell 302A. However, if the rear cells 302B are drained first during the normal drainage process, then the lateral valves 510 will open and water from the front cells 302A will flow out.

Figure 6:
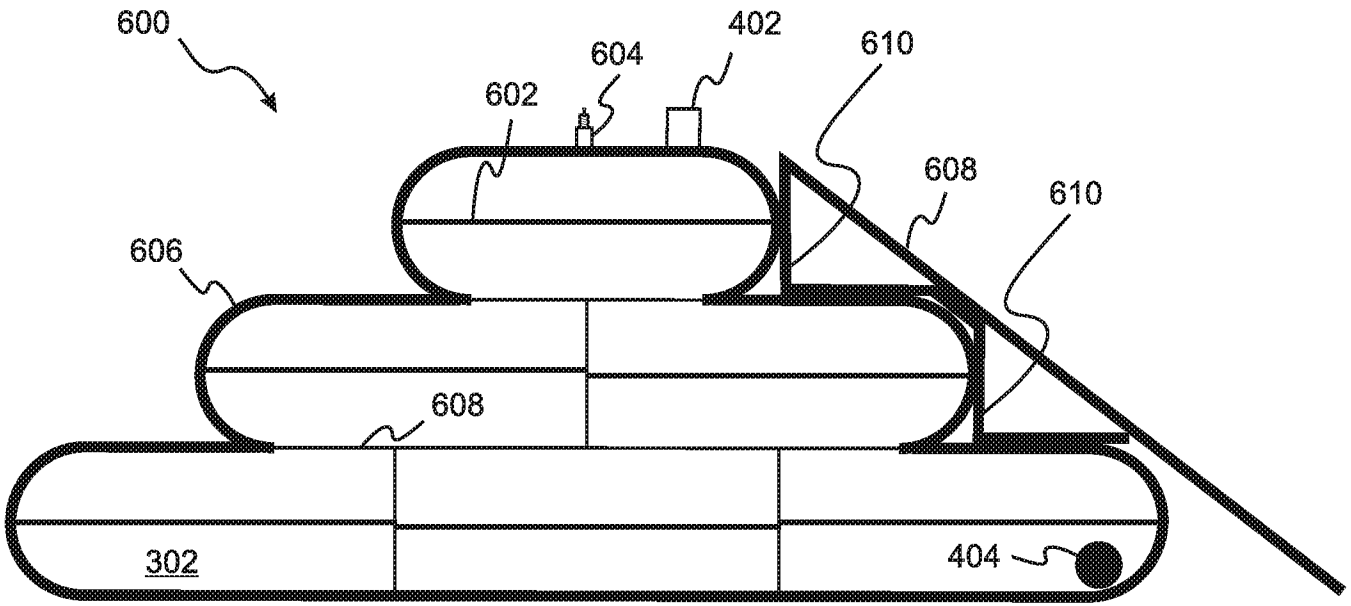
FIG. 6 is a cross sectional view of an embodiment that includes stiffening rods within the cells.

With reference to FIG. 6, in some embodiments the outer shell is made of a much thicker material than the internal cell walls 608, so as to better resist puncture by exterior threats. In similar embodiments, the outer shell 606 is a double layer of material, so that penetration of the outer layer does not affect the adjacent cell, so long as the inner layer remains intact. In some embodiments, only the portion of the outer shell 606 that will face the flood or other threat is thicker, double-walled, or otherwise reinforced.

In embodiments, the internal cell walls enable the barrier 300 to maintain its shape when it is subjected to externally applied lateral forces, such as pressure from flood waters. As illustrated in FIG. 6, in some embodiments, the shape of the barrier 600 is made even more rigid by including within the cells 302 stiff, lightweight rods 602 or panels made of plastic, bamboo, or a similar material.

In certain embodiments, the shape of the barrier is supported by external reinforcing structures. The embodiment of FIG. 608 includes a plurality of bent metal rods 608 that can be located at intervals along the rear side of the barrier 600. The rods 608 include vertical sections 610 that can be placed against the back sides of cells at the rear of the barrier 600 so as to provide further resistance to horizontal forces applied to the front of the barrier.

In some embodiments, the barrier 600 can be initially inflated with air, so that the barrier 600 can be easily positioned while it is in its inflated configuration. The barrier 600 can then be filled with water, while the displaced air is released through a pressure valve 604 at the top of the barrier 600.

Figure 7:
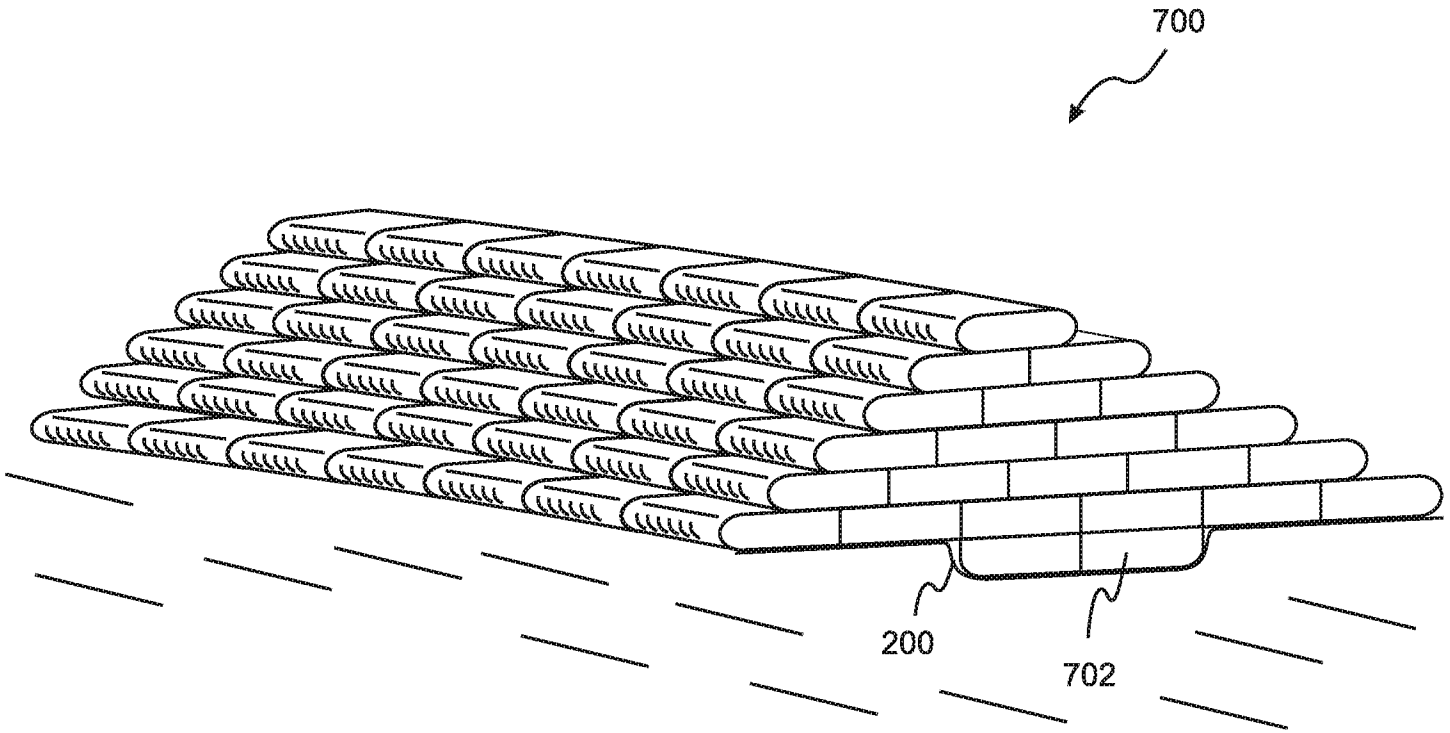
FIG. 7 is a perspective view of an embodiment that has two additional rows of cells at its base that are placed in a trench prepared at the construction site.

With reference to FIG. 7, in further embodiments, additional rows 702 of cells extend below the base of the inflatable barrier 700 so that they can be placed in a trench 200 prepared at the construction site, thereby further resisting dislodgement of the barrier 700 by flood waters or other forces.

Figure 8:
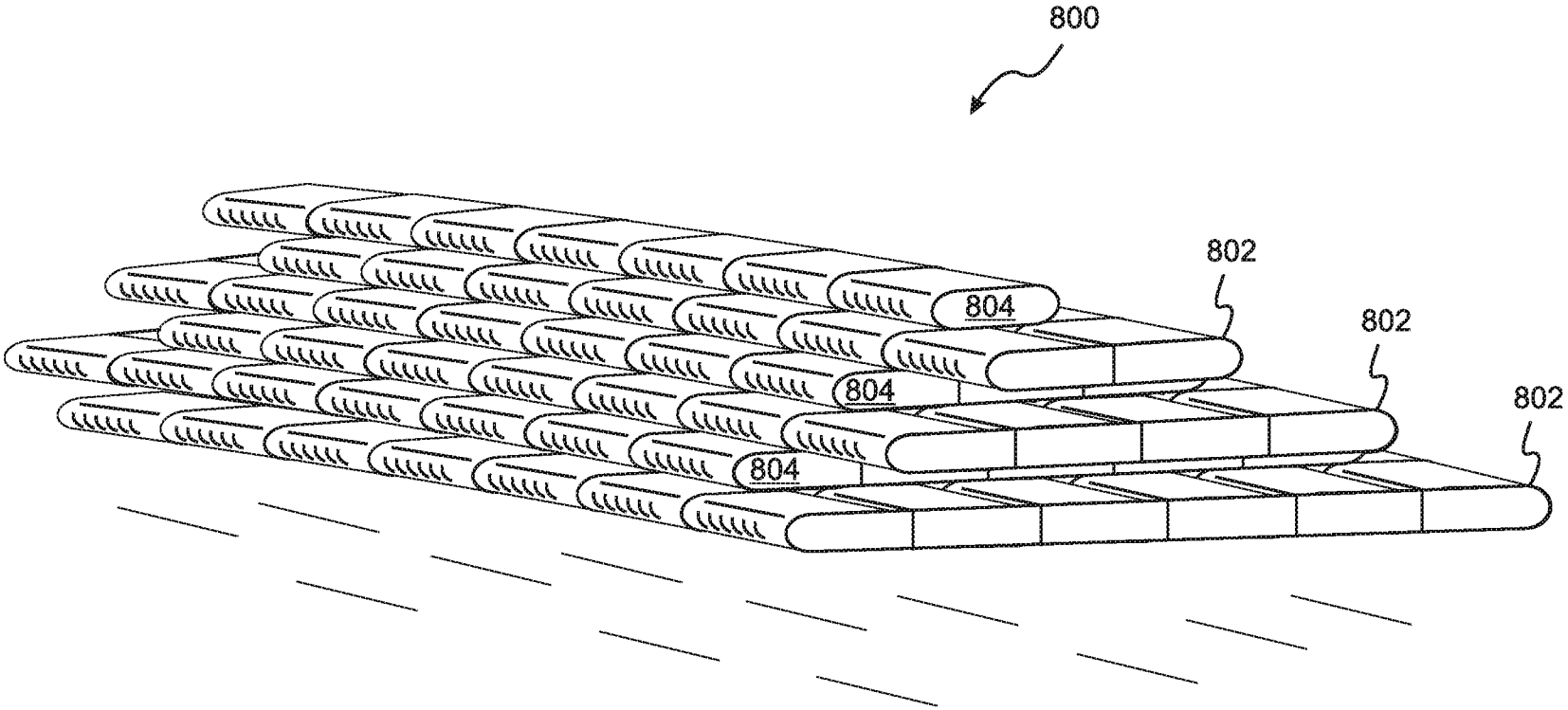
FIG. 8 is a perspective view of an embodiment that has interlocking ends.

In circumstances where a long wall or dike is required, a plurality of barriers of the present invention can be placed side-by-side. With reference to FIG. 8, in some embodiments the barriers 800 have interlocking ends that provide structural cooperation and a water-tight seal between adjacent barriers. In the embodiment of FIG. 8, alternate rows of cells 802 extend from the end by a length of one cell, while the interleaved rows 804 do not. The opposite pattern is provided on the other end of the barrier 800. It can be seen that a second barrier of the same configuration can be positioned so that its extended cells fit between the extended cells 802 of the adjacent barrier 800. In some of these embodiments, as mentioned above, the barrier 800 can be initially filled with air, and then positioned with the ends interlocking, after which the barriers are filled with water while the displaced air is allowed to escape through pressure valves provided at the tops of the barriers 800.

Figure 9A:
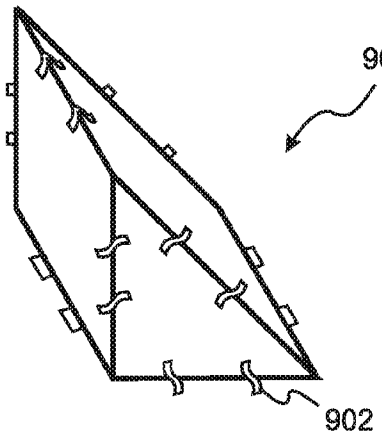
FIG. 9A is a perspective view of an individual, inflatable module having a triangular cross section that can be combined with similar modules to form a barrier in embodiments of the present invention.
Figure 9B:
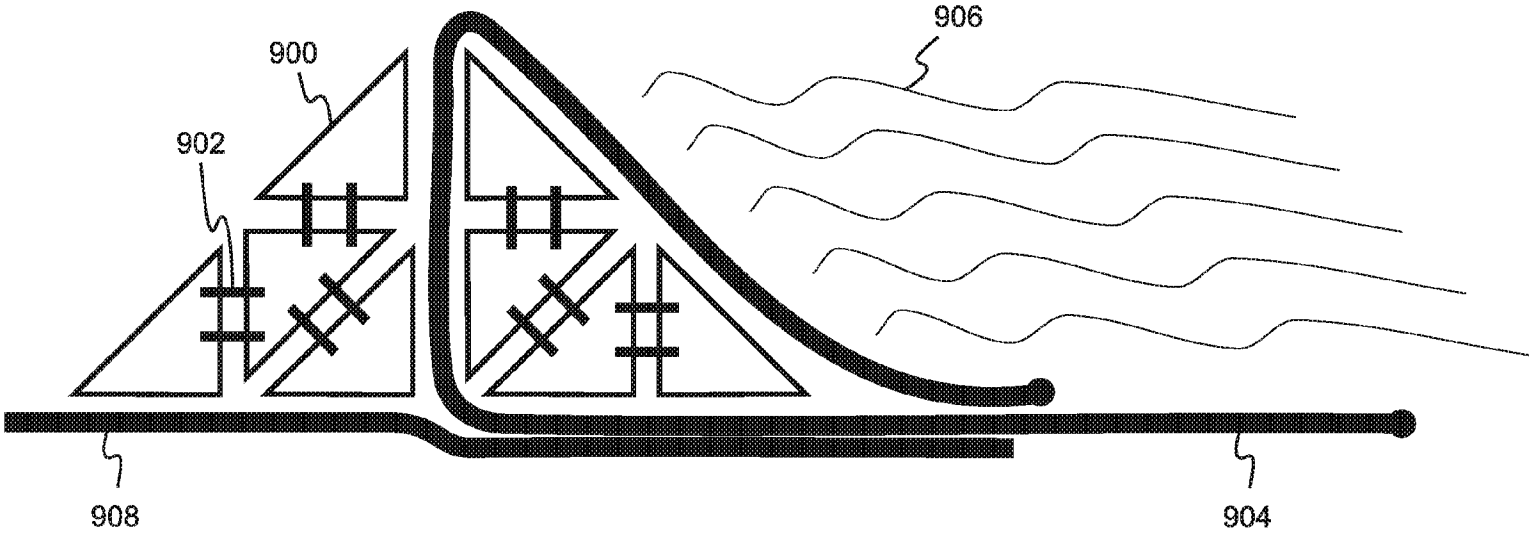
FIG. 9B is a cross-sectional view of a barrier constructed using the modules of FIG. 9A, and further including an anchoring sheet and an underlying sheet.

With reference to FIGS. 9A and 9B, in a second general aspect of the present invention the barrier is assembled from individual, water-inflatable modules 900 that include attachment mechanisms 902 such as ties, hook-and-loop, or some other attachment mechanism known in the art. In the embodiment of FIGS. 9A and 9B, the modules have a triangular cross-sectional shape. As illustrated in FIG. 9B, this enables them to be assembled to form a barrier having a desired overall shape, such as a pyramid. While the base of the barrier is only slightly wider than the height in FIG. 9B, in other embodiments the base is at least six times as wide as the height.

In the embodiment of FIG. 9B, the sloping shape of the water-facing surface causes the water pressure to press the barrier against the ground and thereby increases friction and helps the barrier to resist being shifted horizontally by the water. The embodiment of FIG. 9B further includes an anchoring sheet 904 that is attached to the barrier and extends in front of the barrier, where it is pressed against the ground by the water 906 in front of the barrier, so that there is a high friction between the anchoring sheet 904 and the ground that further inhibits lateral movement of the barrier by the water 906.

The anchoring sheet in the embodiment of FIG. 9B is wrapped around the forward-located modules of the barrier, thereby attaching the anchoring sheet 904 to the barrier. In similar embodiments, the anchoring sheet 904 is wrapped around the entire barrier, or is attached to the barrier by some other means known in the art.

In some embodiments, the anchoring sheet 904 is sufficiently flexible to allow it to conform closely with the underlying shape of the water-facing surface. And in some of these embodiments, the anchoring sheet 904 is made from a material that naturally clings to the water-facing surface of the barrier due to static electrical attraction.

In embodiments, the flexible material of the barrier allows the base of the barrier to form a seal with ground even if the ground is rough. The embodiment of FIG. 9B further includes a flexible underlying sheet 908 that increases resistance to puncture of the barrier from beneath, and which forms a seal with the ground so as to further resist penetration of water beneath the barrier. In some of these embodiments, the underlying sheet 908 includes a cushioning layer such as foam or a puncture-proof air bag that enables the underlying sheet to form a seal with very rough ground, and also further helps to avoid puncture of the barrier from beneath. In certain of these embodiments, the underlying sheet 908 is filled with dry sand, foam or some other compliant material that will not get wet from the flood water.

Figure 10:
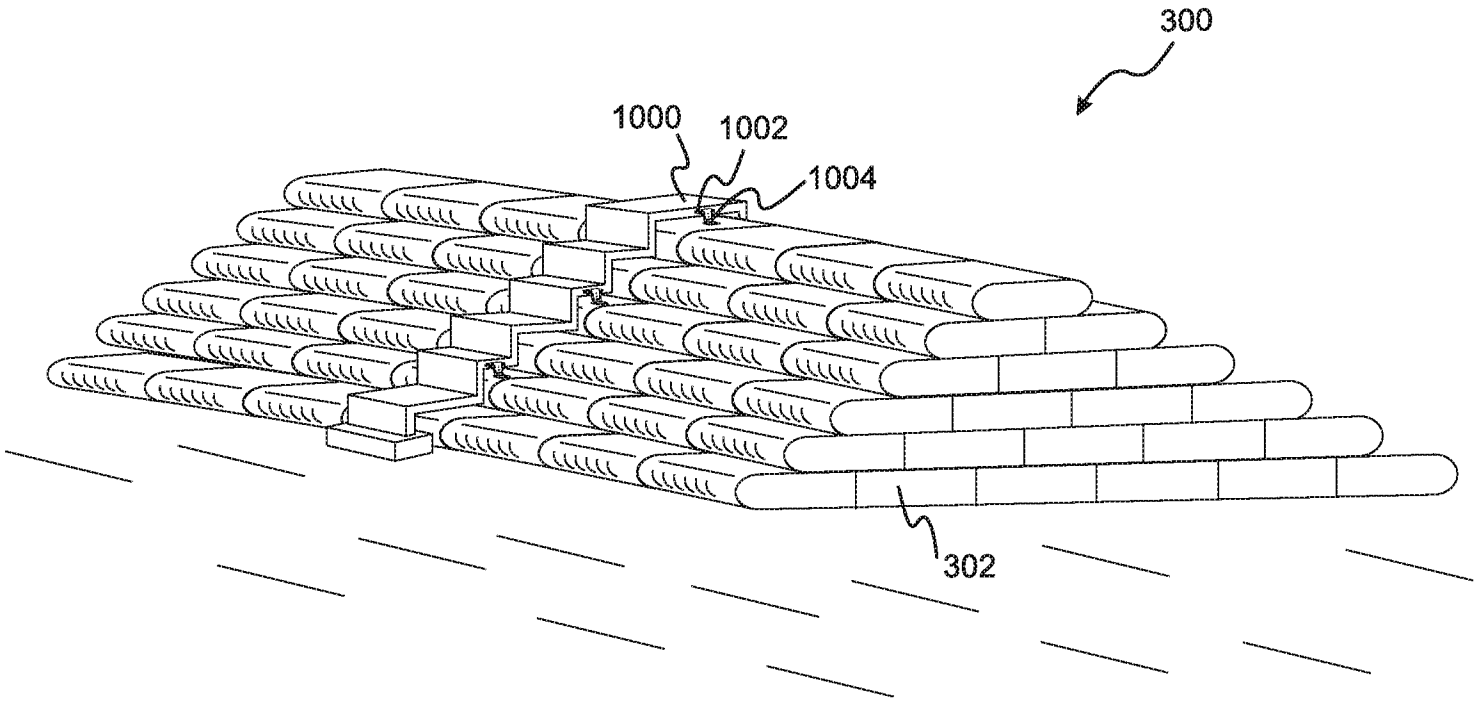
FIG. 10 is a perspective view of an embodiment of the present invention which includes steps that provide a means for crossing the barrier and also provides vertical support to the barrier.

With reference to FIG. 10, some embodiments include steps 1000 that provides a convenient means for crossing the barrier 300. The steps 1000 are configured to be free-standing, but to conform somewhat closely to the outer shape of the barrier 300, so as to provide additional structural support to the barrier 300 by inhibiting changes to the barrier's shape. In the embodiment of FIG. 10, the steps 1000 further provide vertical support to the barrier 300 by including coupling features 1002 on the steps 1000 that can be attached to complementary coupling features 1004 provided on the top of the barrier 300.

Figure 11:
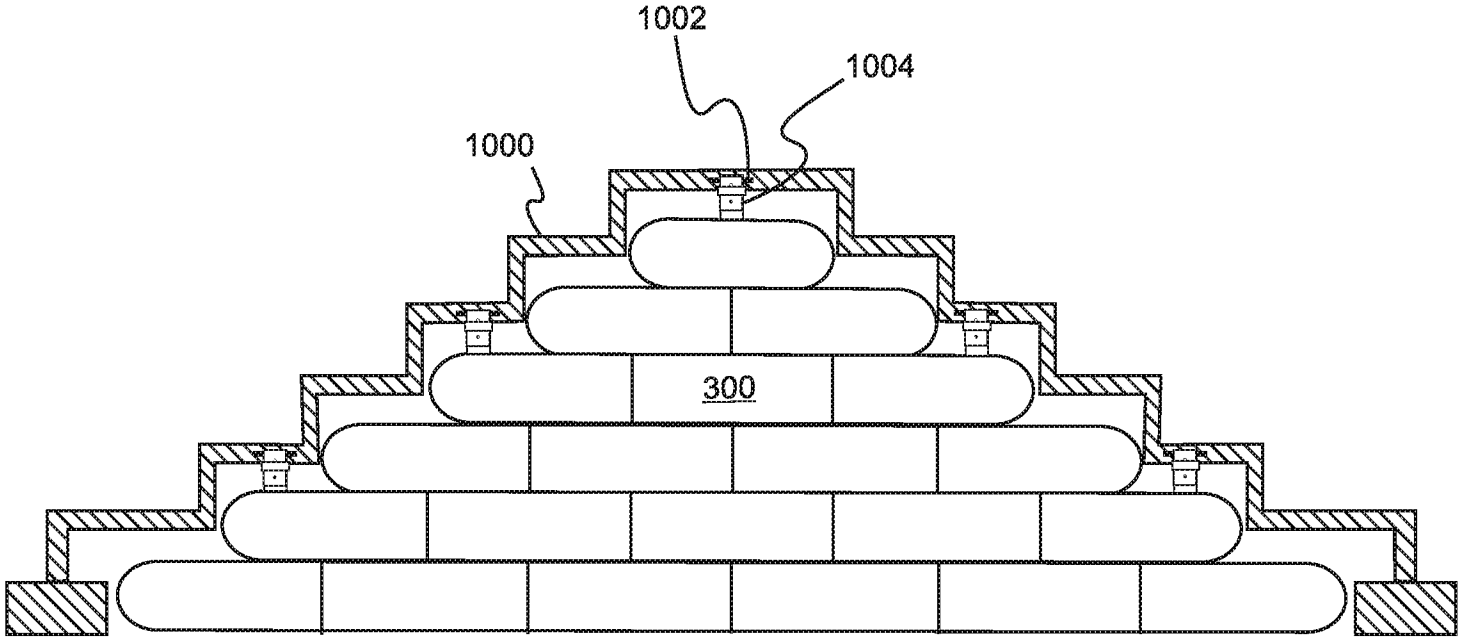
FIG. 11 is a cross-sectional view of the embodiment of FIG. 10.

FIG. 11 is a cross-sectional view of the embodiment of FIG. 10, where the relationship between the steps 1000 and the barrier 300 can be more clearly seen. A vertical offset between the steps 1000 and the barrier 300 is included in FIG. 11, which simplifies the illustration of the coupling mechanisms 1002, 1004. In other embodiments, such as the embodiment of FIG. 13, the steps 1000 include little or no vertical offset from the top of the barrier 300, and in some of these embodiments the steps apply a small vertically downward pressure to the top of the barrier 300.

Figure 12:
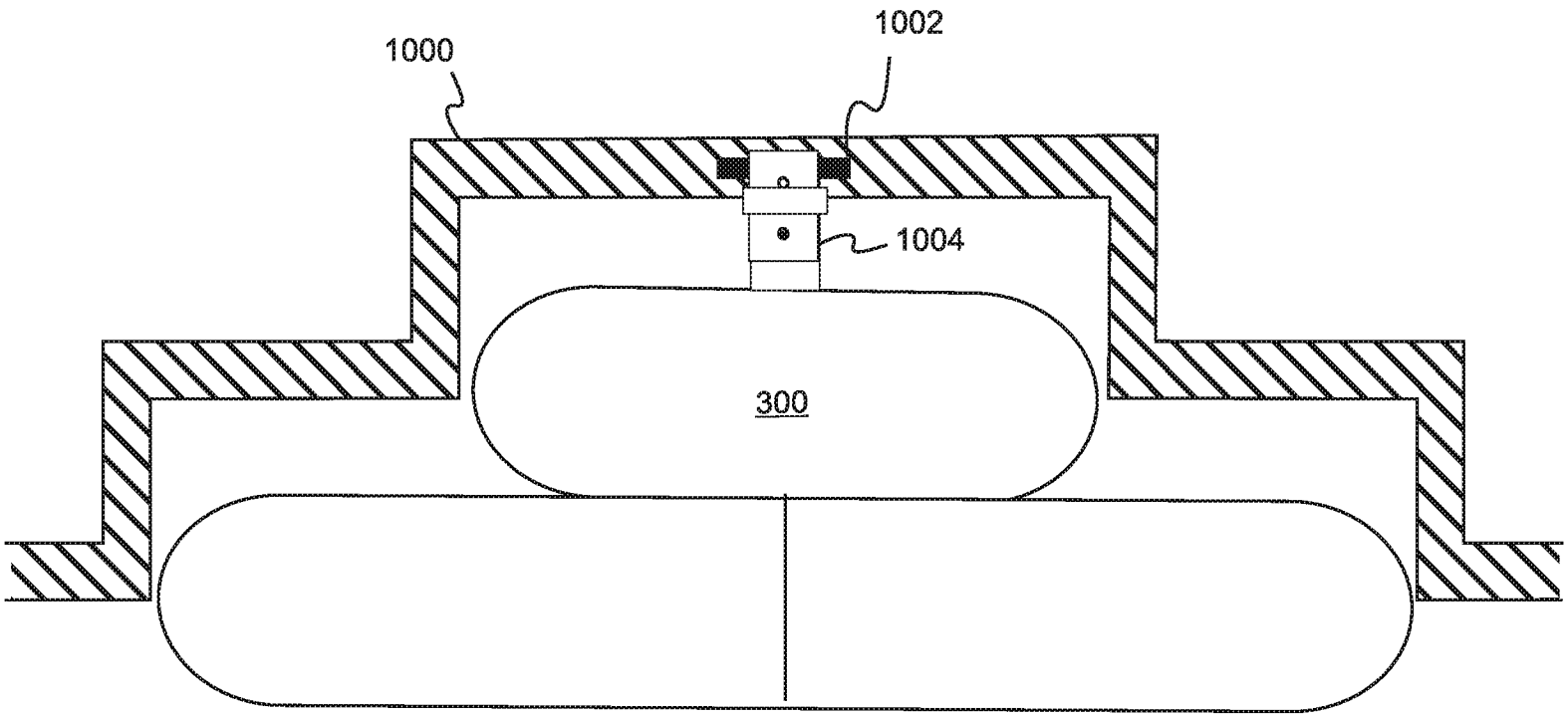
FIG. 12 is a close-up view of the top of FIG. 11.
Figure 13:
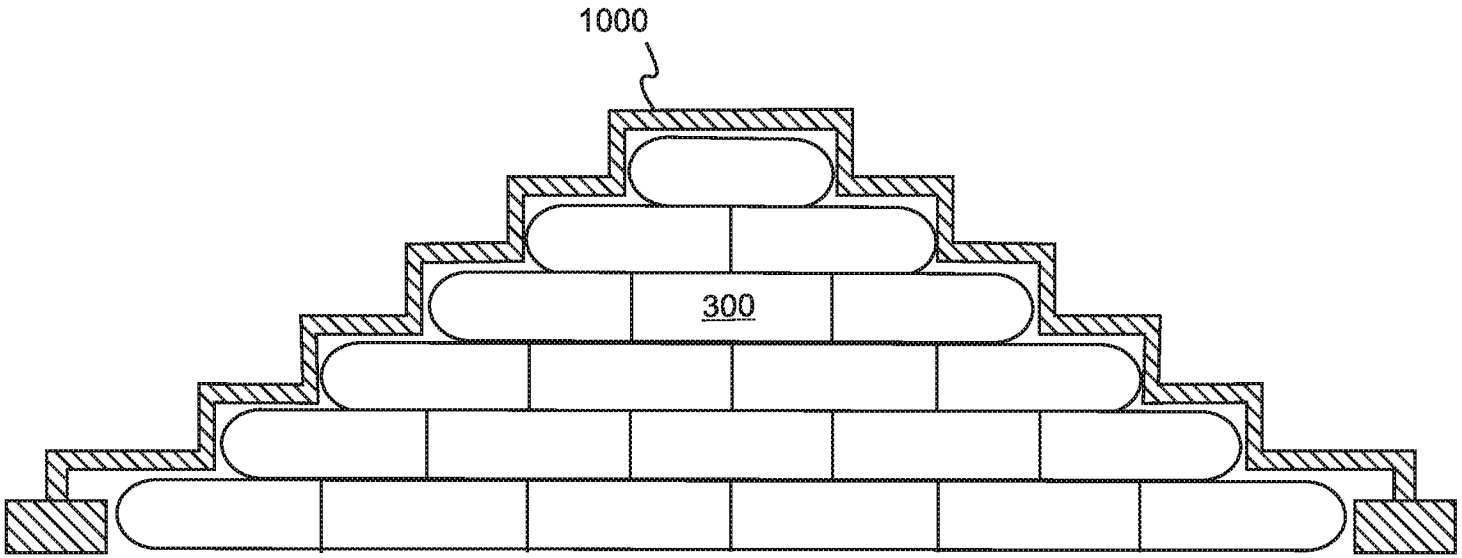
FIG. 13 is a cross-sectional view of an embodiment similar to FIG. 11, but wherein the steps do not provide vertical support to the barrier, but is optimized to inhibit distortion of the shape of the barrier.

FIG. 12 is a close-up view of the top of the embodiment of FIG. 11, wherein the coupling features 1002, 1004 can be more clearly seen. In FIGS. 10-12, a strap 1004 is attached to the top of the barrier 300, and is looped through and buckled to a rigid loop 1002 that extends from the side of the steps 1000. While FIGS. 10-12 present a specific example of coupling features, it will be understood that the scope of the invention includes all coupling mechanisms known in the art, such as hooks, clamps, bolted brackets, nuts and horseshoe bolts, and such like. With reference to FIG. 13, it will also be understood that some embodiments do not include coupling of the steps 1000 to the barrier 300.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A water inflatable module suitable for use as a barrier or incorporation into a barrier, the module comprising:

flexible walls configured to contain water within an interior of the module, said module having a front, a rear, a length parallel to the front, a width perpendicular to the front, and a substantially uniform cross-section along its length, the cross section being wider at a base of the module than at a top of the module;

a plurality of substantially horizontal and substantially vertical partition walls dividing said interior into a plurality of adjacent, water-tight cells shaped as rectangular parallelepipeds, front and rear partition walls of each cell being substantially parallel to the front of the shell, said cells being arranged in a plurality of vertically stacked layers that are offset from each other such that none of the front and rear partition walls aligns with a front or rear partition wall in a vertically adjacent layer;

a water inlet; and a plurality of passages between the cells configured to allow filling of all of the cells with water from the water inlet.

2. The module of claim 1, further comprising a structure reinforcing element that is external to the flexible walls.

3. The module of claim 1, further comprising rigid steps spanning the width of the flexible walls in substantial conformance with a step-wise cross-sectional shape of the flexible walls, the steps being configured to enable an individual to traverse the flexible walls.

4. The module of claim 3, further comprising a first coupling mechanism attached to the steps and a second coupling mechanism attached to the flexible walls, the coupling mechanisms being configured for attachment of the steps to the flexible walls.

5. The module of claim 4, wherein the coupling mechanisms are configured to enable the steps to provide vertical support to the flexible walls.

6. The module of claim 1, further comprising an automatic valve cooperative with a vertical passage between adjacent cells and configured to automatically seal the vertical passage when the cell below the vertical passage is filled with water.

7. The module of claim 1, further comprising an automatic valve cooperative with a horizontal passage between adjacent cells and configured to automatically seal the horizontal passage when the cell located to the rear of the horizontal opening is filled with water.

8. The module of claim 1, wherein the module includes an interlocking side structure configured to interlock with a second module having a compatible side structure.

9. The module of claim 1, wherein the module is inflatable with air.

10. The module of claim 1, wherein the base of the module is flat.

11. The module of claim 1, wherein the base of the module includes at least one row of cells extending below other rows in the base, the extended rows being configured for placement in a trench prepared at a site where the module is to be installed.

12. The module of claim 1, wherein the flexible walls are reinforced at least at the front of the module as compared to the partition walls.

13. The module of claim 12, wherein the flexible walls at the front of the module are reinforced due to an increased thickness of material relative to the partition walls.

14. The module of claim 12, wherein the flexible walls at the front of the module are reinforced due to inclusion of a material not included in the partition walls.

15. The module of claim 12, wherein the flexible walls at the front of the module are reinforced due to inclusion of nanofiber in the flexible walls.

16. The module of claim 12, wherein the flexible walls at the front of the module are reinforced due to double-walled construction.

17. The module of claim 1, wherein the flexible walls include a coating of a protective material that tends to seal punctures.

18. The module of claim 17, wherein the protective material is tyvec or liquid rubber.

19. The module of claim 1, further comprising an underlying sheet that resists puncture of the flexible walls from beneath, and which seals to the module and to the ground beneath the module so as to inhibit penetration of water beneath the module.

20. The module of claim 19, wherein the underlying sheet is a cushioning layer.

21. The module of claim 19, wherein the underlying sheet is filled with dry sand or foam.

22. The module of claim 1, further comprising a plurality of said modules aligned with adjacent sides so as to collectively form a water barrier, dam, or dyke.

* * * * *